US005860771A

United States Patent [19]

Ditcher et al.

[11] Patent Number: 5,860,771

[45] Date of Patent: Jan. 19, 1999

[54] RETAINING WALL/TIE-BACK/ANCHOR ASSEMBLY

[75] Inventors: Jack Ditcher, Langhorne; Gary K. Munkelt, Doylestown, both of Pa.

[73] Assignee: Atlantic Precast Concrete Inc., Tullytown, Pa.

[21] Appl. No.: 832,073

[22] Filed: Apr. 2, 1997

[51] Int. Cl.[6] ..... E02D 29/02

[52] U.S. Cl. ..... 405/262; 405/284

[58] Field of Search ..... 405/262, 284, 405/286, 272, 258

[56] References Cited

U.S. PATENT DOCUMENTS

| | | | |
|---|---|---|---|
| 1,762,343 | 6/1930 | Munster | 405/262 |
| 2,018,423 | 10/1935 | Smith | 405/262 |
| 2,703,963 | 3/1955 | Gutierrez | 405/262 |
| 4,266,890 | 5/1981 | Hilfiker | 405/286 |
| 4,661,023 | 4/1987 | Hilfiker | 405/284 X |
| 4,834,584 | 5/1989 | Hilfiker | 405/258 X |
| 5,127,770 | 7/1992 | Ditcher et al. | 405/262 |
| 5,407,303 | 4/1995 | Manns | 405/262 |

*Primary Examiner*—Dennis L. Taylor

*Attorney, Agent, or Firm*—Louis Weinstein

[57] ABSTRACT

A retaining wall assembly having a plurality of face plates, which interlock with tie-backs. The face blocks in one embodiment have a substantially cross-shaped front face and recesses along top, bottom, left and right-hand sides, which interlock with tie-back flanges. Each tie-back, through its interlocking flange, interlocks with four adjacent face plates. The tie-backs have anchors which provide stability and anti torsion, and comprise elongated rods joined to a key block at a forward end, which is further provided with a stiffener plate. The back feet, which are preferably rebars, are welded to the key block and extend rearwardly therefrom. A plurality of anchor plates are arranged at spaced (preferably equi-spaced) intervals therealong and are joined thereto preferably by welding. Tie-backs of a plurality of lengths N×K are provided where N is a real integer and K is a given length. In addition, tie-back extensions may be joined to a tie-back or another tie-back extension in the field. At least one anchor plate of a tie-back and at least one anchor plate of a tie-back extension are interlocked and then bolted together after being interlocked to extend tie-back lengths where necessary in the field. The rebar, together with the anchors and key plates are preferably formed of galvanized steel.

17 Claims, 6 Drawing Sheets

6' LONG TIEBACK

9' LONG TIEBACK

12' LONG TIEBACK

6' TIEBACK EXTENSION 10
12
14
16
16a
16b
16c
16d
20
20a
20b
20c
20d
32
32a
32a'
32'
32''
32'''
32b'
32b'''
12,14

RETAINING WALL/TIE-BACK/ANCHOR ASSEMBLY

FIELD OF THE INVENTION

The present invention relates to retaining wall assemblies, and more particularly to a novel improved combination face plate/tie-back assembly.

BACKGROUND OF THE INVENTION

Retaining walls are typically provided adjacent to highways, bridges, overpasses and the like and are designed to support highway fills or cuts especially in those applications where there is insufficient room adjacent such highways, bridges, overpasses and the like for providing an unsupported and natural slope.

Conventional retaining wall assemblies are typically comprised of substantially T-shaped or L-shaped members which include a face block and an integral elongated bar extending away from the face plate. Such integral members may be cast as a unitary structure from a suitable casting material such as is disclosed in U.S. Pat. No. 4,684,294, issued Aug. 4, 1987 or alternatively, may be cast of a casting material and further provided with a metallic reinforcing bar such as is disclosed in U.S. Pat. No. 4,067,166, issued Jan. 10, 1978. The above-mentioned structures are extremely heavy and significantly complicate the fabrication, handling and assembly of such large and bulky components. In addition, the elements have limited interlocking capabilities which degrade the strength, stability and ruggedness of the completed retaining wall assembly. Other systems reduce the weight of the overall structure by utilizing metallic bars which are mechanically fastened between face plates and anchor members, typically being anchored to the face plates and wrapped about the anchor members as disclosed in U.S. Pat. No. 4,514,113, issued Apr. 30, 1985. These structures have the disadvantage of experiencing significant corrosion in use requiring replacement at a much more frequent rate than retaining wall assemblies formed of rugged, non-corrosive materials, such as concrete. U.S. Pat. No. 4,514,113 describes a retaining wall system employing metallic rods joining the face plates and anchor members. The face plates of the retaining wall assembly disclosed in U.S. Pat. No. 4,514,113 also fails to disclose interlocking means for reinforcing, stabilizing and strengthening the face plates when fully assembled.

In order to overcome the disadvantages of the above retaining wall assemblies, the inventors of the present application developed the novel retainer wall assembly described in U.S. Pat. No. 5,127,770, issued Jul. 7, 1992, which is incorporated herein by reference thereto and which describes a retainer wall assembly characterized by comprising separate face plates and tie-backs incorporating a suitable casting material and which interlock with one another in a unique and simple fashion to provide a rugged, stable and durable retainer wall assembly.

In one preferred embodiment, each face plate has a substantially cross-shaped outline and is provided with recesses along its top, bottom, left and right sides, which recesses cooperate with interlocking flanges provided at the forward end of each tie-back, the interlocking flanges causing each tie-back to interengage and lock in place four adjacent face plates. The face plates are interengaged by the tie-back/anchors in a unique fashion to further enhance the structural strength and alignment of the face of the retaining wall. Each tie-back extends rearwardly a distance which is a function of the height of the retaining wall and the free end of each tie-back is provided with stabilizing, anchoring feet extending in opposite directions from the tie-back to add further stability of the retaining wall assembly by resisting horizontal forces of the tie-backs and hence the face plates. Each member of the retaining wall assembly is simply aligned and lowered into place upon associated members and is automatically interlocked into the assembled position during the lowering operation thus simplifying assembly operations and totally eliminating the need for separate fastening members. Each face plate is cast of a suitable non-corrosive casting material which eliminates the need for metallic coupling bars, or other coupling elements employed in existing retaining wall systems, as a result of the unique interlocking arrangement thereby preventing the need for early repair and replacement of the retaining wall assembly due to corrosion.

The retaining wall assembly requires only two types of face plates, namely a face plate having a flat bottom edge for use as the first course of the retaining wall assembly; and a second type of face plate of the cross-shaped outline. The tie-backs, although identical in design regardless of which course they are employed in, preferably vary in length as a function of the height of the retaining wall assembly. Various lengths of tie-back/anchors may be employed for constructing a retaining wall. The longest are approximately 80% of wall height.

Each of the face plates of the preferred embodiment is provided with a substantially flat forward and rearward surface. As an alternative embodiment, however, the forward surfaces of the face plates may be made flat and the face plates may be provided with integral projections which extend rearwardly and are each provided with a recess for receiving and engaging the locking flanges of a cooperating tie-back. This alternative embodiment reduces the weight of the face plate.

In still another preferred embodiment of the present invention, the cross-shaped face plates may be substituted by face plates having a rectangular shape and provided with a pair of substantially T-shaped recesses along the top and bottom sides thereof for receiving and locking with the interengaging flanges of four tie-backs in such a manner that each face plate is interlocked with four adjacent face plates by way of the tie-backs. This latter embodiment requires only one type of face plate, thus reducing the number of components required to construct a retaining wall assembly.

BRIEF DESCRIPTION OF THE INVENTION

The inventors have developed an improved combined retaining wall/tie-back assembly in which the tie-backs are each formed of a pair of elongated steel rebars each joined at one end thereof to a key plate, preferably by welding. A stiffener plate is positioned between the rebars and is welded to the key plate to enhance the structural strength thereof.

Anchor plates are arranged at spaced intervals along the pair of rebars, and are provided with elongated slots for receiving the rebars, which are welded to the anchor plate after being positioned at the bases of their associated slots. Each anchor plate is provided with an elongated bolt hole.

Tie-backs are preferably produced having a plurality of different lengths. In the preferred embodiment, tie-backs are usually an integral multiple of the distance between anchor plates and/or the distance between the key plate and the closest plate. In the preferred embodiment, this distance is typically three (3) feet resulting in the production of key blocks of lengths typically an integral multiple of three (3) feet (i.e. 3, 6, 9, 12 . . . feet).

Key blocks of the preferred embodiment are typically eight (8) inches by sixteen (16) inches having a thickness of an order of ⅝ inch. The key block and anchors are typically joined by number 5 rebars (⅝" dia).

The anchor plates are preferably rectangular-shaped members, and in one preferred embodiment, are five (5) inches by ten (10) inches and ⅜ inch thick.

Each anchor plate is provided with a pair of slots extending inwardly from one long side of the anchor plate by a depth of the order of 2.50 inches. An elongated opening is provided in each anchor plate, and is located between the slots provided in the anchor plate, and equi-distant from the aforesaid slots.

The face plates are typically the same general configuration as the face plates disclosed, for example, in FIG. 1*c* of U.S. Pat. No. 5,127,770, however, the thickness of the steel key plate of each tie-back is significantly reduced as compared with the cast key blocks shown, for example, in FIGS. 9*a* and 9*b* of U.S. Pat. No. 5,127,770, permitting the addition of concrete to the face panel in critical stress areas.

Tie-back extensions formed of a pair of rebars and a plurality of anchors arranged at spaced intervals therealong, may be utilized to extend a regular tie-back or may be added to another tie-back extension to further extend the tie-back, where required.

Tie-back anchors are interlocked to one another by arranging the tie-back anchor so that the rebars secured to one of the tie-back anchors are inserted into the elongated slot of the tie-back anchor to which it is to be joined. The plates are then pressed together and bolted by insertion of a bolt through the elongated openings in the two (2) tie-back anchors to be joined which are automatically brought into alignment when the rebars of each anchor plate being joined are properly positioned within the slots of the other anchor plate to be joined thereto. The tie-back extension is firmly secured to the tie-back (or tie-back extension) to which it is joined by insertion of a threaded bolt through the aligned elongated slots. A fastening nut threadedly engages the bolt to clamp the two (2) joined anchor plates, thus enabling tie-backs of a variety of different increasing lengths to be provided for in the field. In addition, the use of tie-back extensions permits the shipment of tie-backs of reduced length simplifying handling and reducing transportation costs.

OBJECTS OF THE INVENTION

It is therefore one object of the present invention to provide a novel combination face plate/tie-back assembly.

Still another object of the present invention is to provide a novel combination face plate/tie-back assembly employing tie-backs formed of only steel components.

Still another object of the present invention is to provide a novel combination face plate/tie-back assembly employing tie-backs formed of steel components wherein the use of the steel components, including an anchor plate of reduced thickness as compared with prior cast material key blocks, enhances the combined assembly by providing rebars of a strength at least equal to and in fact superior to tie bars using key blocks formed of cast material as well as enhancing the structural strength of the face plates due to the reduced thickness of the steel key plates, enabling added cast material to be introduced to the face plates thus increasing the structural strength of the face plates in critical stress areas.

BRIEF DESCRIPTION OF THE FIGURES

FIG. 3*a* shows a top view of a tie-back showing a detail of the vertical joint formed between the face plates and the key block of the tie-back.

FIG. 3*a*-1 shows a sectional view of a portion of the retaining wall of FIG. 3*a*.

FIG. 3*b* shows a side view of the arrangement of FIG. 3*a*.

FIG. 3*b*-1 shows a sectional view of a portion of the retaining wall of FIG. 3*b*.

FIG. 3*b*-2 shows an end view of the forward portion of the tie-back in FIG. 3*b*.

FIG. 3*b*-3 shows an end view of one of the anchor plates of FIG. 3*b*.

DETAILED DESCRIPTION OF THE INVENTION AND PREFERRED EMBODIMENTS THEREOF

Figure 1A:
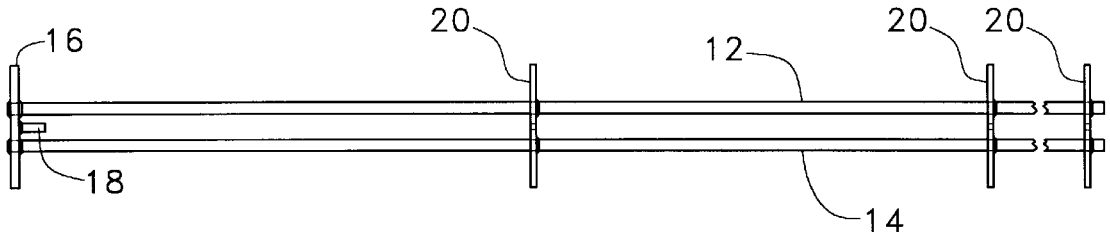
FIGS. 1*a* and 1*b* show top and side views respectively of a tie-back design in accordance with the principles of the present invention.

FIGS. 1*a*–1*d* show a tie-back 10 embodying the principles of the present invention, and comprised of a pair of rebars 12 and 14. The forward end of the tie-back is provided with a key plate 16, the left-hand ends of rebars 12 and 14 being secured to key plate 16, preferably by welding. A stiffener plate 18 is welded to the rear surface of key plate 16 providing additional stiffening strength for the key plate.

A plurality of anchor plates 20 are arranged at spaced intervals along rebars 12, 14 and are each provided with a pair of elongated slots 20*a*, 20*b* extending inwardly from edge 20*c*. Rebars 12 and 14 are respectively arranged at the bases of the slots 20*a*, 20*b*, as shown in FIG. 1*d*. The rebars 12, 14 are welded to each anchor plate 20. After all of the anchor plates and key plate are welded to the rebars, the tie-back, which is formed of steel, is galvanized as a unit, preferably through a hot dip galvanizing treatment.

Each of the anchor plates 20 are further provided with an elongated opening 20*d* to permit tie-back extension sections, to be more fully described, to be joined to a tie-back.

In one preferred embodiment, the anchor plate 20 closest to the key plate 16 is spaced apart therefrom by a distance of three (3) feet 4.75 inches. The next anchor plate to the right thereof is separated from the anchor plate closest to the key plate by a distance of the order of three (3) feet. Additional anchor plates are provided as and when needed, and the separation distance is in accordance with the overall length of the tie-back.

A typical tie-back is of the order of six (6) feet in length, and can be either shorter or longer, depending upon the particular application.

Figure 2A:
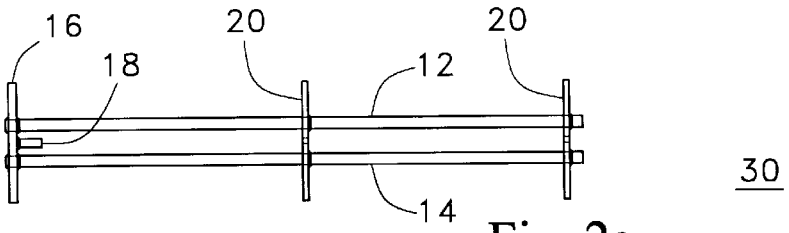
FIGS. 2*a*–2*c* are top views showing tie-backs of different lengths embodying the design of the tie-backs shown in FIGS. 1*a* and 1*b*.
Figure 2B:
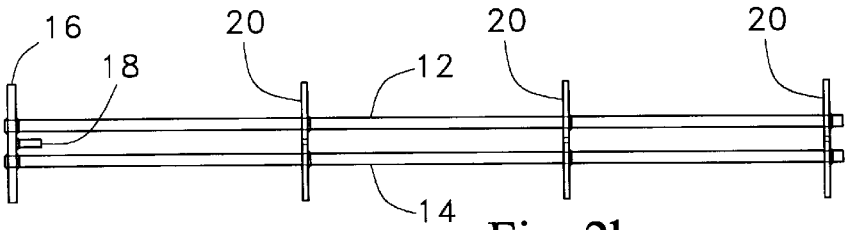
Figure 2C:
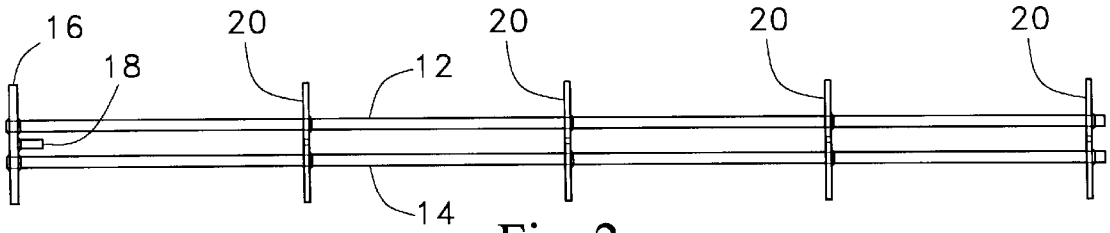

FIGS. 2*a*–2*c* respectively show tie-backs of a length of six (6) foot six (6) inches; nine (9) foot six (6) inches, and twelve (12) foot six inches (6). The anchor plates 20 are typically spaced of the order of three (3) feet apart along the pair of rebars.

Figure 2D:
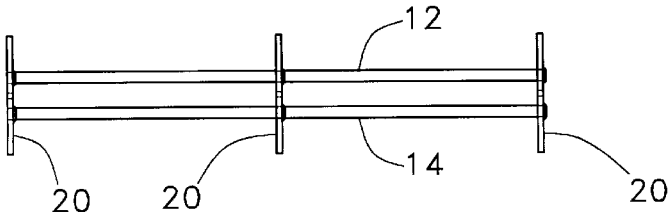
FIG. 2*d* shows a top view of a tie-back extension.

FIG. 2*d* shows a tie-back extension 30, which may be used in the field to extend, i.e. lengthen, a tie-back to accommodate a particular application.

The tie-back extension 30, shown in FIG. 2*d*, is comprised of a pair of rebars 12 and 14, and a plurality of anchor plates 20 with the rebars welded each anchor plate. As was set forth hereinabove, the tie-back extension, as well as the tie-backs of various lengths shown in FIGS. 2*a*–2*c*, are all galvanized as a unit after being welded.

Figure 1B:
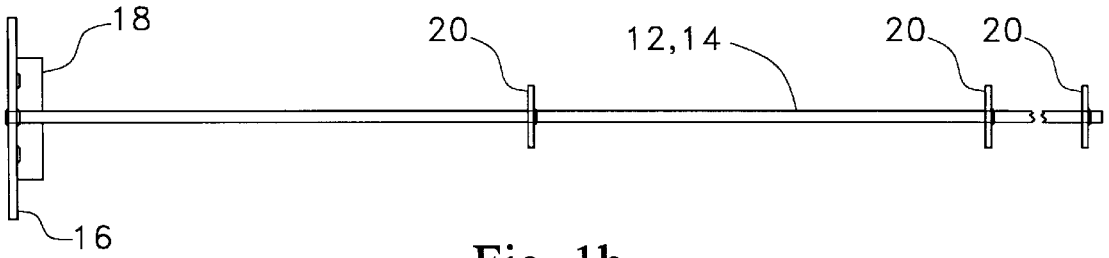
Figure 1C:
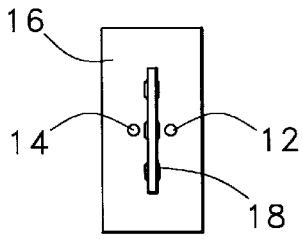
FIG. 1*c* is a detailed plan view of a key plate employed in the tie-back assembly of FIGS. 1*a* and 1*b*.
Figure 1D:
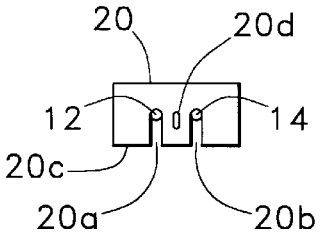
FIG. 1*d* is a detailed plan view of an anchor plate employed in the tie-back assembly of FIGS. 1*a* and 1*b*.
Figure 5:
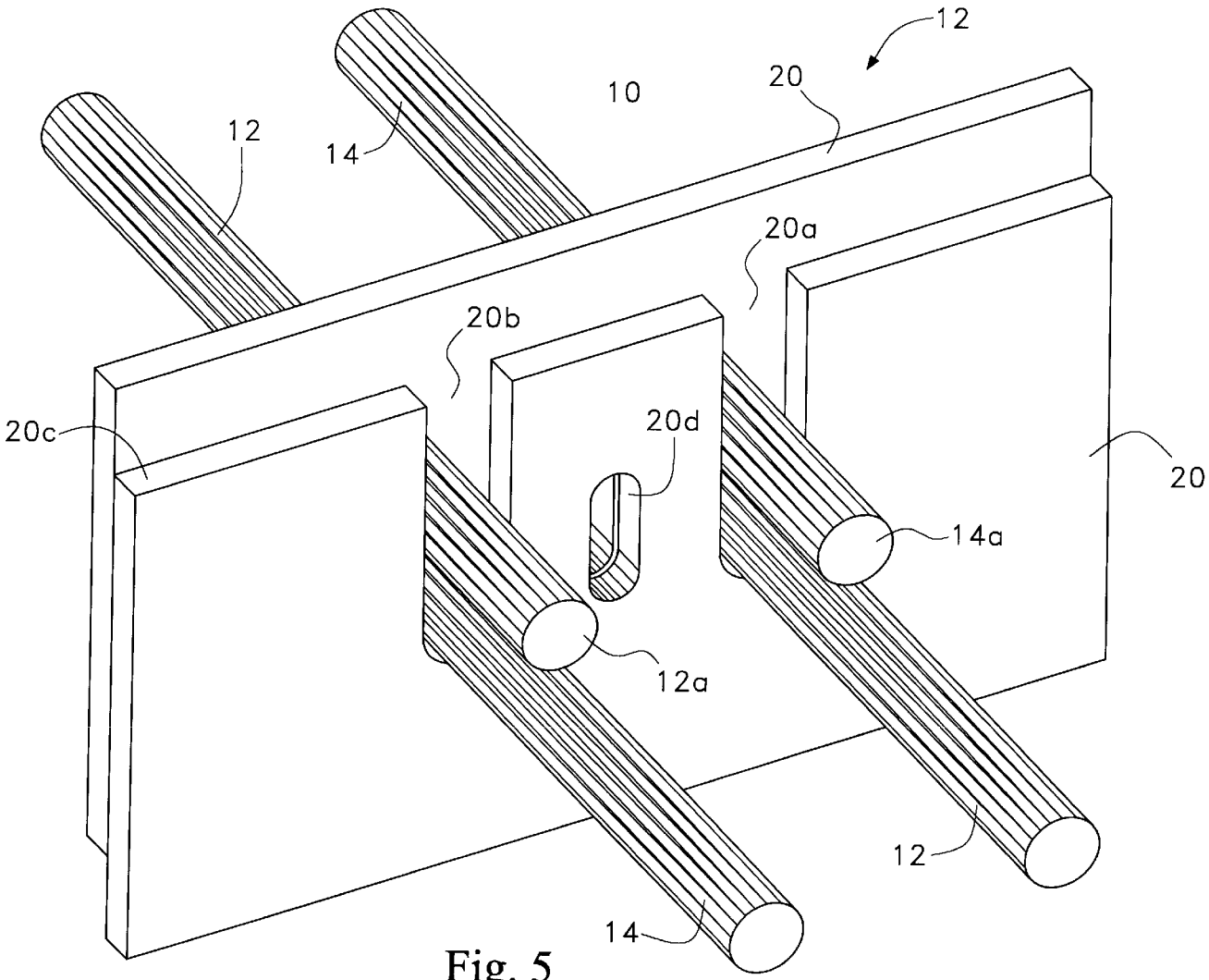
FIG. 5 is a perspective view showing the manner in which a tie-back extension is coupled with a tie-back.

The manner in which a tie-back extension 30 is joined to a tie-back 10 is shown best in FIG. 5, wherein the right-hand-most anchor plate 20 of tie-back 10 shown in FIGS. 1*a* and 1*b*, and the left-hand anchor plate 20 of the tie-back extension 30 shown in FIG. 1*d* are arranged so that the anchor plates 20, 20 shown in FIG. 5 have their slots 20*a*, 20*b* facing one another. The right-hand ends of the tie-back rebars terminate just beyond the right-hand-most anchor plate as shown at 12*a* and 14*a*. The rebars of the tie-back extend into the slots 20*a*, 20*b* of the extension anchor plate while the rebars 12 and 14 of the extension extend into the slots of the anchor plate at the right-hand end of the tie-back.

When the rebars and anchor plates are arranged in the manner shown in FIG. 5, the elongated openings 20*d*, which are mid-way between the slots 20*a* and 20*b*, are aligned and fastening means such as a threaded bolt is extended through the aligned openings 20*d*. A threaded nut is mounted onto the fastening member and tightened, thereby firmly securing the anchor plates 20, 20 to one another. If desired, one or more extensions may be secured to a tie-back to meet particular applications.

FIGS. 3*a*–4*d* show the manner in which a tie-back is arranged with a plurality of interlocked face plates.

Figures 1, 2, 3, 3A, 3B:
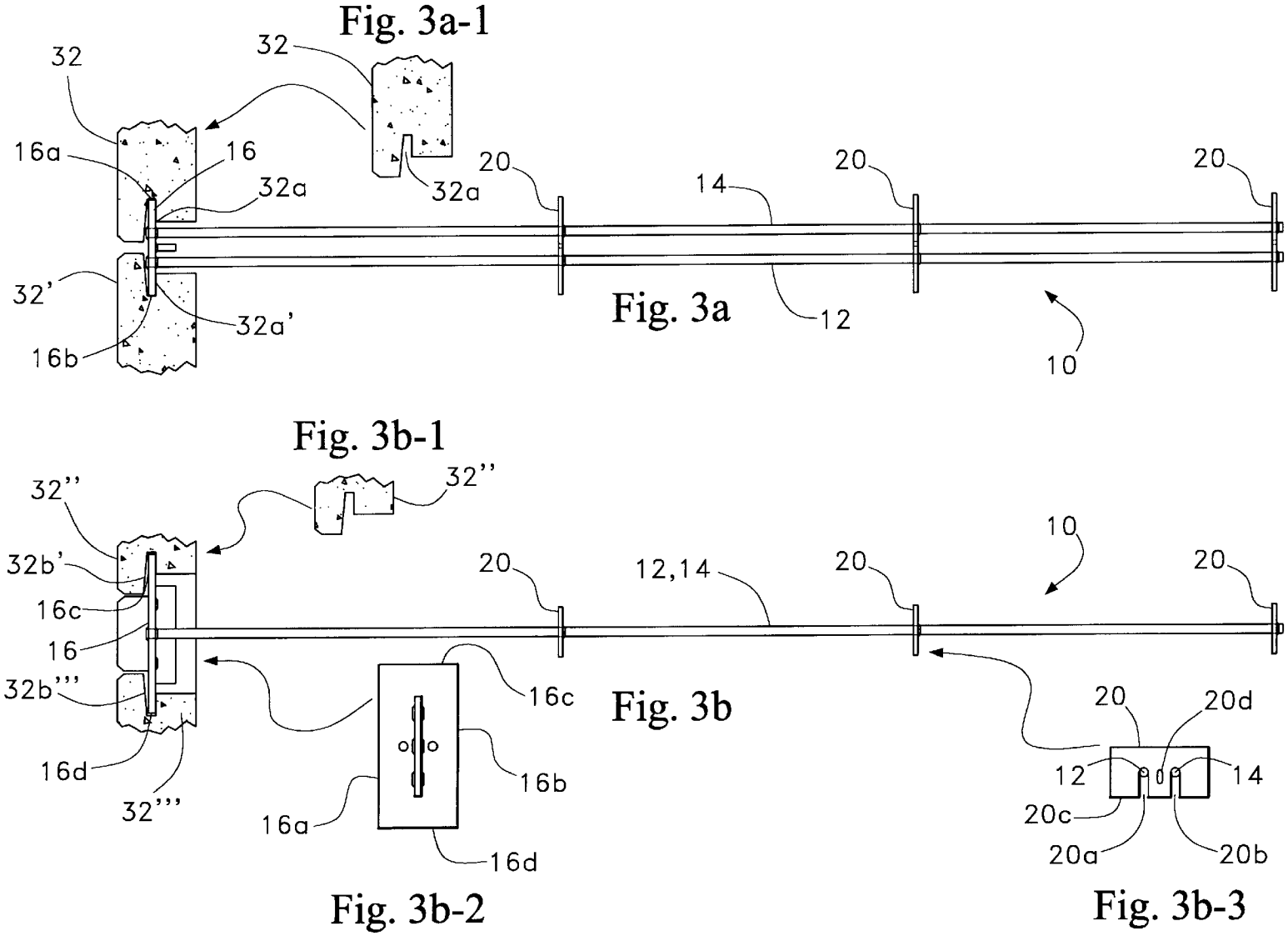

As was described hereinabove, the face plates may be of the type shown, for example in FIGS. 1*a*–3 of U.S. Pat. No. 5,127,770, and each face plate has a substantially cross-shaped configuration provided with upwardly and downwardly directed projections and left and right-hand directed projections extending from a central portion thereof. Each of the projections is provided with a slot for receiving the key block 16 of a tie-back 10, the key block being interlocked with left-hand and right-hand projections of adjacent face plates, and upwardly directed and downwardly directed projections of another pair of adjacent face plates as shown, for example, in FIG. 3 of the aforementioned U.S. Pat. No. 5,127,770. FIGS. 3*a* and 3*b* herein respectively show top and side views of a tie-back 10. Noting FIG. 3*a*, which shows a top view of tie-back 10, key plate 16 has a left-hand vertical side 16*a* extending into a vertically aligned slot 32*a* in a right-hand directed portion of a face plate 32 arranged to the left of the tie-back 10, and has a right-hand edge 16*b* extending into a slot 32*a*' of a left-hand directed portion of a face plate 32' positioned to the right of vertical side 16*b* of key block 16, the right-hand vertically aligned edge 16*b* extending into slot 32*a*'.

FIG. 3*b* shows a side view of tie back 10, the upper edge 16*c* of which extends into a slot 32*b*″ of a downwardly directed portion of a face plate 32*b*″ arranged above key block 16, and in which the lower edge 16*d* extends into a slot 32*b*‴ of an upwardly directed portion a face plate 32‴ arranged below the key block 16 of tie-back 10.

Figure 4B:
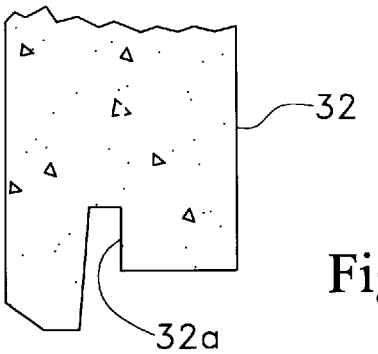
FIG. 4*b* shows one of the face plates of FIG. 4*a* in greater detail.
Figure 4A:
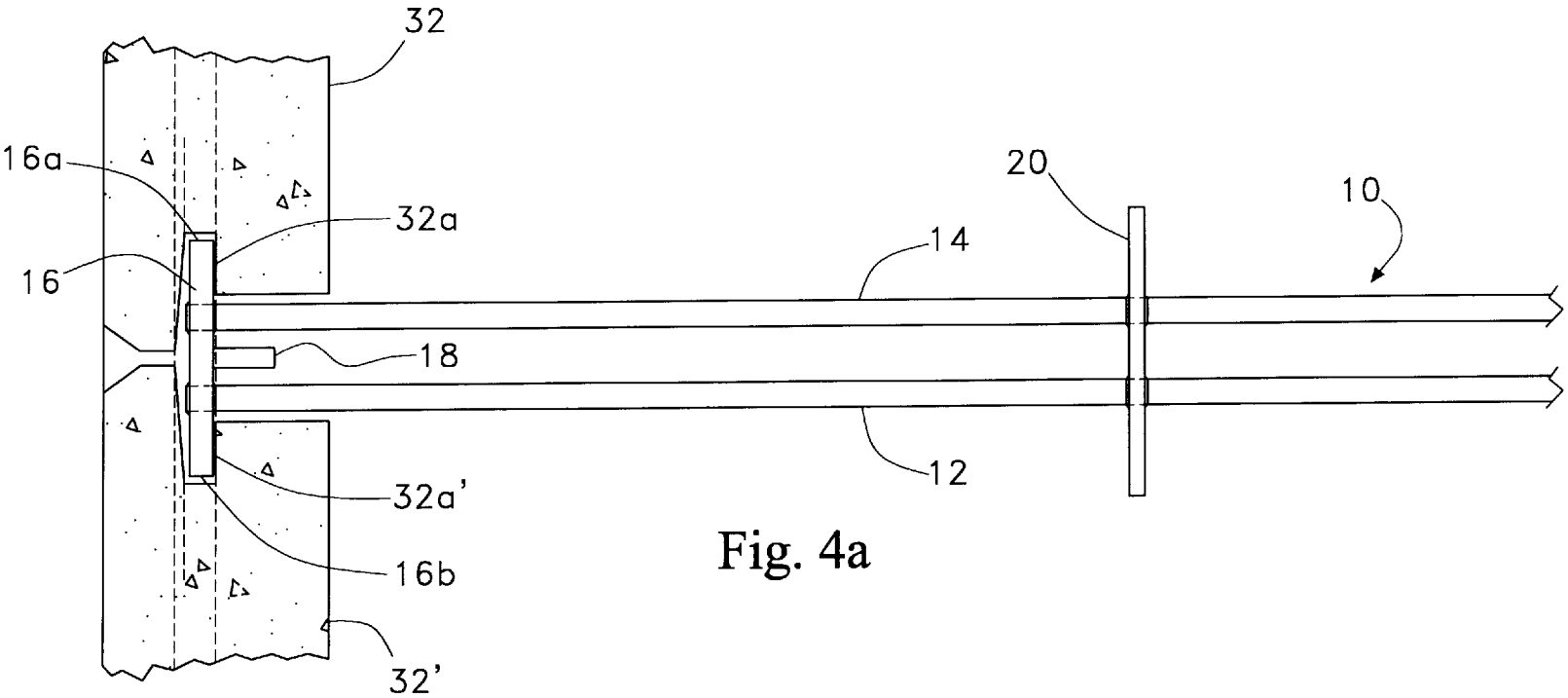
FIG. 4*a* shows an enlarged view of a vertical joint detail of FIG. 3*a*.
Figure 4D:
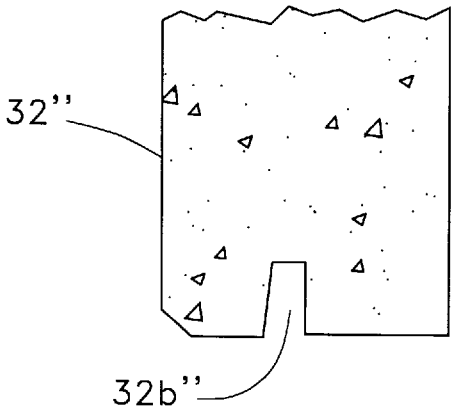
FIG. 4*d* shows a detailed view of one of the face plates appearing in FIG. 4*c*.
Figure 4C:
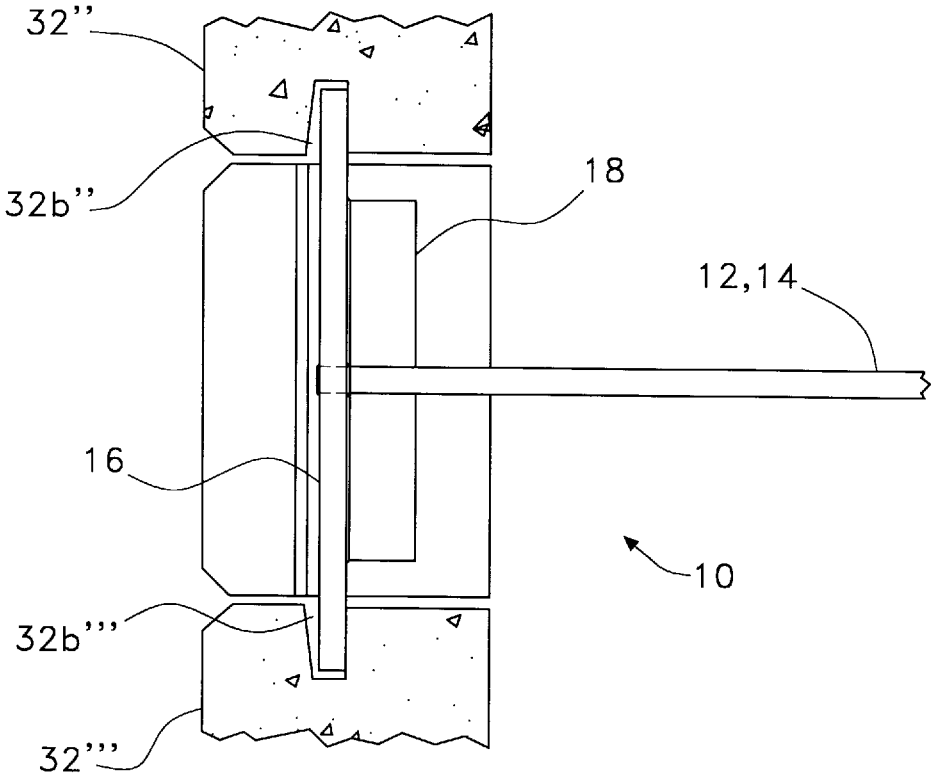
FIG. 4*c* shows an enlarged view of the horizontal joint detail of FIG. 3*b*.

FIGS. 4*a* and 4*b* show the vertical joint detail and top view of tie-back 10 in greater detail, and enlarged as compared with FIG. 3*a*.

The tie-backs 10 may be employed with equal success in the face plate assembly shown, for example, in FIG. 8 of U.S. Pat. No. 5,127,770.

The use of an all steel tie-back permits the slots 32*a*, 32*a*', 32*b*" and 32*b*‴ *to be of reduced width due to the reduced thickness of the key block, which, in the preferred embodiment is of the order of* ⅝ inch thick, thus enabling important build-up of the cast material in critical areas of the face plate. The preferred embodiment preferably utilizes a key block having a width of eight (8) inches and a length of sixteen (16) inches. A stiffener 18 having a length of ten (10) inches and a width of two (2) inches and a thickness of ½ inch. The anchor plates are preferably 5×10 inches, and have a thickness of ⅜ inch. The rebars are preferably No. 5 rebars (⅝"), grade 60.

The tie-backs are buried in the earth in the same manner as set forth in the aforementioned U.S. Pat. No. 5,127,770, and serve to prevent tilting of the face plates 32 from a vertical alignment. The use of a pair of rebars for each tie-back further prevents the bar and the associated face plates from twisting.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A retaining wall assembly comprising:

a wall face comprised of a plurality of engaging face plates;

each plate having a cross-shaped front face including projections extending from and surrounding a centered face said projections facing in upward, downward, leftward and rightward directions when the face plate is vertically oriented in said wall assembly;

all of said projections having interlocking sides provided with locking recesses displaced rearwardly from the front face;

a plurality of tie-backs each having an elongated body portion and an integral interlocking flange arranged at one end of said body portion;

said interlocking flange being received in selected recesses of at least three adjacent, engaging face plates including the interlocking recesses in adjacent left and right side portions;

said tie-backs being aligned with their elongated body portions arranged substantially perpendicular to said face plates and being of a length adapted to enhance the stability of the retaining wall assembly;

said tie-backs each having a pair of rods arranged and spaced in parallel fashion and secured to a metallic key block at one end thereof and secured to an anchor plate at an opposite end thereof;

said key block having a substantially rectangular shape, the upper and lower edges of each key block extending into interlocking slots provided in face plates arranged respectively above and below the key block and having left and right-hand edges respectively extending into interlocking slots provided in face plates respectively arranged in the left and right-hand sides of said key block; and said tie-backs being aligned with their elongated rebars arranged substantially perpendicular to said face plates and being of a length adapted to enhance the stability of the retaining wall assembly.

2. The retaining wall assembly of claim 1 wherein said face plates are formed of a suitable casting material and said tie-backs are formed of metal.

3. The retaining wall assembly of claim 2 wherein said casting material is a suitable concrete.

4. The retaining wall assembly of claim 2 wherein said key block, anchor plates and rebars are formed of steel.

5. The retaining wall assembly of claim 4 wherein said rebars are welded to said key block and said anchor plate.

6. The retaining wall assembly of claim 5 wherein said steel rebars, key block and anchor plates are galvanized as a unit.

7. The retaining wall assembly of claim 2 wherein the thickness of the key plate is of the order of 0.675 inches.

8. The retaining wall of claim 7 wherein the slots in said face plates are of the order of 0.875 inches in width.

9. The retaining wall assembly of claim 1 wherein said tie-back interlocking flange has a height which is at least equal to the height of the elongated body portion and wherein said flange extends a predetermined distance away from the opposite sides of said elongated body portion to define a T-shaped configuration with said body member.

10. The retaining wall assembly of claim 1 wherein each tie-back is provided with an integral stabilizing and anchoring flange at the end of said tie-back opposite said interlocking flange.

11. The retaining wall assembly of claim 10 wherein said stabilizing flange comprises a pair of flange portions extending in opposite directions and arranged on opposing sides of said elongated body portion and being adapted to rest upon a back fill layer provided behind the retaining wall assembly, said stabilizing and anchoring flange of the retaining wall assembly enhances the wall stability by restraining horizontal forces from the soil and thus preventing the wall from overturning or sliding.

12. The retaining wall assembly of claim 1 wherein the rearward surface of each face plate is provided with a central cavity to provide a reduced thickness portion of the face plate in the central region thereof.

13. The retaining wall assembly of claim 9 wherein the region behind the retaining wall assembly is back filled with earth which is placed against the rear surfaces of said face plates and into the central cavities in the rearward surface of each face plate to enhance the structural strength of the retaining wall assembly.

14. A tie-back assembly comprising a plurality of metallic rods arranged and spaced in substantially parallel fashion;

a metallic key block, first ends of said rods being welded to said key block;

a metallic anchor block arranged a spaced distance from said key block;

said anchor plate being provided with a pair of elongated slots extending inwardly from one edge of said plate;

said rods each extending into one of said slots and being arranged against a base of its associated slot;

said rods being welded to said anchor plate; and said anchor plate is further provided with an elongated opening for coupling to an anchor plate of a tie-back extension.

15. A tie-back assembly according to claim 14 wherein said tie-back extension comprises a pair of metallic rods arranged and spaced in parallel fashion;

at least two anchor plates arranged near opposite ends of said rods, each of said anchor plates being provided with a pair of elongated slots extending inwardly from one edge of said plate;

said rods each extending into one of said slots and being arranged against a base of its associated slot;

said rods being welded to said anchor plate.

16. A tie-back assembly according to claim 15 wherein said tie-back extension to joined to said tie-back so that ends of the rods of said tie-back extend beyond said tie-back anchor plate and are inserted into slots of one of the anchor plates of said tie-back extension and the rods of the tie-back extension extend beyond the said one of said anchors of said tie-back extension and are inserted into the slots of the tie-back anchor plate; and fastening means extending through said elongated slots for securing the tie back anchor plate to the said one of the anchor plates of the tie-back extension.

17. A retaining wall assembly comprising:

said retaining wall assembly having a wall face comprised of a plurality of engaging face plates;

each face plate having upper, lower, left and right-hand sides surrounding a front face;

at least two of said sides being provided with locking recesses displaced rearwardly from the front face;

a plurality of tie-backs each having an elongated body portion and an integral interlocking flange arranged at one end of said body portion;

said interlocking flange being received in the recesses of at least first and second adjacent, engaging face plates;

said tie-backs being aligned with their elongated body portions arranged substantially perpendicular to said face plates and being of a length adapted to enhance the stability of the retaining wall assembly;

said tie-backs comprising:

a pair of rods arranged and spaced in parallel fashion and secured to a metallic key plateblock at one end thereof and secured to an anchor plate at an opposite end thereof;

said key plate having a substantially rectangular shape, the upper and lower edges of the key plate extending into interlocking slots provided in face plates arranged respectively above and below the key block and having left and right-hand edges respectively extending into interlocking slots provided in face plates respectively arranged in the left and right-hand sides of said key block; and said tie-backs being aligned with their rebars arranged substantially perpendicular to said face plates and being of a length adapted to enhance the stability of the retaining wall assembly.

* * * * *